United States Patent [19]

Kaizu et al.

[11] 4,264,789

[45] Apr. 28, 1981

[54] VOICE COIL ASSEMBLY FOR A SPEAKER

[75] Inventors: Yasuo Kaizu; Kiyoshi Saito, both of Yokohama, Japan

[73] Assignee: Victor Company of Japan, Limited, Yokohama, Japan

[21] Appl. No.: 78,391

[22] Filed: Sep. 24, 1979

[30] Foreign Application Priority Data

Sep. 26, 1978 [JP] Japan ..... 53-131989[U]

[51] Int. Cl.[3] ..... H04R 9/02

[52] U.S. Cl. ..... 179/115.5 PV

[58] Field of Search ..... 179/115.5 PV, 115.5 VC, 179/181 R

[56] References Cited

U.S. PATENT DOCUMENTS 3,209,084 9/1965 Gamzon et al. ..... 179/115.5 PV 3,497,642 2/1970 Pintell ..... 179/181 R 3,922,502 11/1975 Tabuchi ..... 17/115.5 PV

*Primary Examiner*—Daryl W. Cook

*Attorney, Agent, or Firm*—Lowe, King, Price & Becker

[57] ABSTRACT

A voice coil assembly for a speaker comprises a substrate, a spiral pattern coil formed on the substrate, at least one holder fixedly secured to the periphery of the substrate, and at least one metallic layer attached to said substrate. The metallic layer facilitates the dissipation of the heat generated by the voice coil, while a pair of metallic layers establishes electrical connections between the voice coil terminals and external terminal strips. The shape of the opening of the holder(s) may be made other than rectangular for avoiding the occurrence of standing waves which cause the frequency characteristic of the speaker to be deteriorated.

17 Claims, 16 Drawing Figures

VOICE COIL ASSEMBLY FOR A SPEAKER

FIELD OF THE INVENTION

This invention generally relates to a voice coil assembly of a speaker. More particularly, the present invention relates to a voice coil assembly which is made by photochemical etching processes.

BACKGROUND OF THE INVENTION

Conventional voice coil assemblies manufactured by way of photochemical etching processes, comprises a nonconductive substrate and a metallic spiral pattern layer made on the substrate. The metallic spiral pattern layer functions as a voice coil and the substrate having the voice coil is supported by a suitable holder at the periphery of the substrate, while permanent magnets are located in the vicinity of the coil so that the substrate vibrates when the coil is energized by an input signal.

As is well known, the voice coil tends to generate heat when energized. The degree of this heat generation is a function of the power of the input signal. Since the voice coil is made from a thin microstripline, a high temperature may cause the voice coil to burn out. Therefore, the allowable maximum input power is simply determined by the resistivity of the coil and the efficiency of the heat dissipation. The resistivity of the coil is determined by the thickness and the width of the coil and both the thickness and the width thereof cannot be increased for the following reasons.

A predetermined number of turns has to be made within a limited space on the substrate. Accordingly the increase in the width of the coil results in either the increase in the dimensions of the voice coil assembly or the reduction of the number of turns. The increase in the thickness of the coil results in the increase in weight of the coil assembly deteriorating the efficiency of sound generation especially in a high frequency range. From the above, it is concluded that it is impossible to lower the resistivity of the coil.

Consequently, the only possible way to increase the allowable input maximum power is to increase the efficiency of the heat dissipation. However, according to the prior art the heat generated by the voice coil is dissipated only through the substrate the thermal conductivity of which is relatively low.

Furthermore, according to the conventional technique for manufacturing voice coil assemblies by way of photochemical etching processes, two terminals of the voice coil are respectively connected to two input external terminals of the voice coil assembly by means of conductive lead wires. This means that two lead wires have to be bonded to respective terminals at four places. The lead wires have possibilities of being broken, while the lead wires might be poorly soldered at the respective terminals.

In addition to the above described disadvantages of the conventional voice coil assembly, the frequency characteristic of the conventional speaker of the type above mentioned is not flat because of the existence of standing waves across the voice coil. These standing waves are generated by a holder which supports the substrate when the holder has a central opening defined by two pairs of equidistantly spaced sides.

SUMMARY OF THE INVENTION

The present invention has been developed in order to remove the above described disadvantages and drawbacks of the conventional voice coil assembly.

It is therefore, a primary object of the present invention to provide a voice coil assembly for a speaker in which the heat generated by the voice coil is effectively dissipated so that the allowable maximum input power is increased.

Another object of the present invention is to provide a voice coil assembly for a speaker in which connecting lead wires are omitted, by connecting the terminals of the voice coil by means of metallic layers or plates to the input external terminals of the voice coil assembly.

A further object of the present invention is to provide a voice coil assembly for a speaker in which standing waves are not generated so that the frequency characteristic is improved.

According to the first feature of the present invention, at least one metallic layer or plate is provided at the circumferential portions of the voice coil to effectively dissipate the heat produced by the voice coil. The metallic layer or plate may be formed on a nonconductive substrate on which the voice coil is deposited or on a holder which supports the substrate at the periphery of the substrate.

According to the second feature of the present invention, at least two metallic film or plates are located between the substrate and the holder. Each of the metallic plates is provided with an input external terminal, while the metallic plate is electrically connected to one terminal of the voice coil by means of a conductive member disposed in a through-hole made in the substrate.

According to the third feature of the present invention, the shape of the opening of the holder is made other than rectangular so that the holder which supports the substrate does not generate standing waves which cause the frequency characteristic of the speaker to be deteriorated.

BRIEF DESCRIPTION OF THE DRAWINGS

These and other objects and features of the present invention will become more readily apparent from the following detailed description of the preferred embodiments taken in conjunction with the accompanying drawings in which.

DETAILED DESCRIPTION OF THE PREFERRED EMBODIMENTS

Prior to describing the preferred embodiments of the voice coil assembly according to the present invention, prior art technique will be discussed for a better understanding of the subject matter of the present invention.

Figure 1:
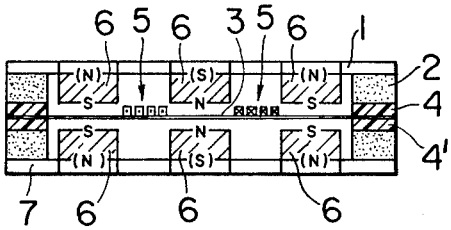
FIG. 1 PRIOR ART
FIG. 1 is a cross-sectional view of a conventional speaker including a voice coil assembly.

FIG. 1 illustrates a cross-sectional view of a conventional speaker including a voice coil assembly which is made by photochemical etching processes. The speaker comprises a pair of iron plates 1 and 7, a plurality of permanent magnets 6 disposed on the inner surfaces of the respective iron plates 1 and 7, and a pair of spacers 2 in addition to the voice coil assembly. The voice coil assembly consists of a substrate 3, a spiral pattern coil 5 formed on the substrate 3, and a pair of holders 4 fixedly secured to the periphery of the substrate 3 in such a manner that the substrate 3 is interposed between the two holdes 4. The voice coil assembly is fixedly secured by the two iron plates via the spacers 2 at the portions of the holders 4 so that the substrate 3 is vibratable between the magnets 6 when energized.

Figure 2:
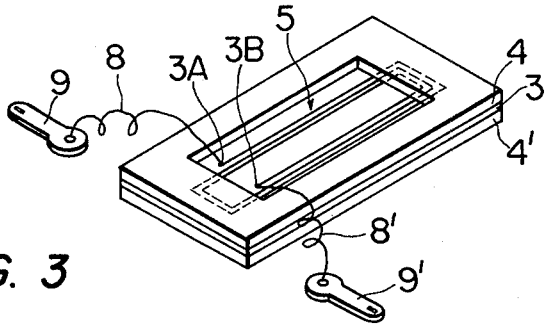
FIG. 2 PRIOR ART
FIG. 2 is a perspective view of the voice coil assembly shown in FIG. 1.

FIG. 2 is a perspective view of the voice coil assembly shown in FIG. 1. The substrate 3 is made of a nonconductive material, while the spiral pattern coil 5 is of course made of a conductive material such as aluminum. Although a few turns of the coil is shown in these drawings, actually a number of turns, such as ten, is provided. Two terminals 3A and 3B of the coil 5 are shown to be connected respectively to two external terminal strips 9 and 9' via connecting lead wires 8 and 8'. The connecting lead wires 8 and 8' are respectively soldered at the terminals 3A and 3B of the voice coil 3 and the terminal strips 9 and 9'. The terminal strips 9 and 9' are, of course, disposed on a nonconductive stationary member (not shown).

The above described conventional speaker including such a voice coil assembly has disadvantages and drawbacks as follows:

(1) Since the heat generated by the voice coil 5 dissipates only through the substrate 3 and the ambient air thereof, the efficiency of the heat dissipation is not very high. This results in a limit of the input power of the speaker.

(2) Since the terminals 3A and 3B of the voice coil 5 are connected to the input external terminals 9 and 9' via connecting lead wires 8 and 8', the lead wires 8 and 8' have a possibility of being broken. Furthermore, poor soldering may cause poor connections between the voice coil terminals 3A and 3B and the terminal strips 9 and 9'.

(3) Since the shape of the holders 4 and 4' are of rectangular, standing waves might appear in the openings of the holders resulting in the deterioration of the frequency characteristic of the speaker.

The above listed defects of the conventional speaker will be solved by the technique according to the present invention as will be described hereinbelow.

Figure 3:
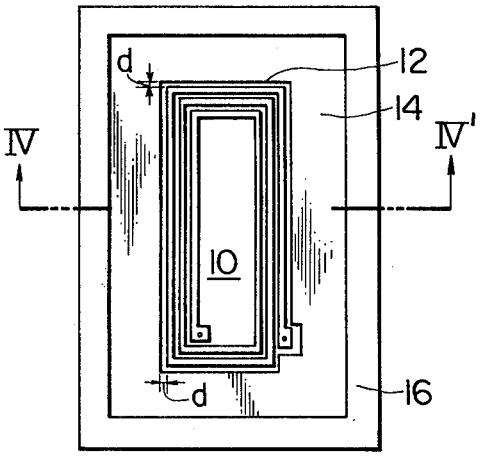
FIG. 3 is a schematic top plan view of a first embodiment of a voice coil assembly according to the present invention.
Figure 4:
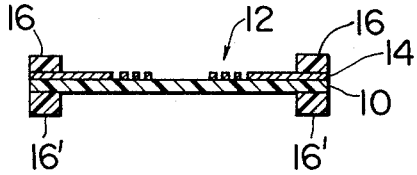
FIG. 4 is a cross-sectional view of the voice coil assembly shown in FIG. 3 taken along the line IV—IV.

Reference is now made to FIG. 3 and FIG. 4 which respectively show a top plan view and a cross-sectional view of a first embodiment of the voice coil assembly according to the present invention. The voice coil assembly comprises a substrate 10 made of a nonconductive material, a voice coil placed on a front side of the substrate 10, a pair of holders 16 and 16' which are made of nonconductive material, such as glass-epoxy (glass fiber curdled by epoxy resin). The voice coil assembly further comprises a metallic layer or plate 14 deposited on the front side surface of the substrate 10. The side on which the voice coil is formed is referred to as a front side, while the other side is referred to as a back side throughout the specification. The voice coil 12 and the metallic layer 14 are formed simultaneously by well known photochemical etching processes. In order to form the voice coil 12 and the metallic layer 14 on the surface of the substrate 10 a thin film or layer of a metal such as aluminum, copper or silver is deposited on the front side thereof by means of suitable adhesive or vapour coating technique. With the thin metallic layer photoetched, a voice coil in the form of a spiral pattern microstripline is formed on the substantially central portion of the substrate 10, while the metallic layer 14 having an opening at the center thereof is formed outside the voice coil 12. This means that the metallic layer 14 surrounds the voice coil 12 in such a manner that the inner most portions of the metallic layer 14 is spaced from the outer most portions of the voice coil 12 by a short distance since the shape of the opening of the metallic layer 14 corresponds to the shape of the voice coil 12. The metallic layer 14 is, therefore, electrically insulated from the voice coil 12.

The metallic layer 14 is provided in order to facilitate the dissipation of the heat generated by the voice coil 12. For the effective transmission of the heat the metallic layer 14 is placed as close as possible to the outer most portions of the voice coil 12. The distance between the outer most portions of the voice coil 12 and the inner most portions of the metallic layer 14 is designated by a reference d and this distance d in this embodiment is 100 microns.

The substrate 10, on which the voice coil 12 and the metallic layer 14 are respectively formed, will be referred to as a vibrating plate hereunder since the substrate 10 vibrates for emitting sounds when energized. The vibrating plate 10, 12, and 14 is supported by the pair of holders 16 and 16' in such a manner that the vibrating plate 10, 12 and 14 is interposed between the two holders 16 and 16' at the peripheral portions of the vibrating plate 10, 12 and 14. With the provision of the metallic layer 14 the heat generated by the voice coil 12 is effectively transmitted to the holders 16 and 16' and to the ambient air so that the allowable maximum input power of the speaker is improved compared to the conventional speaker.

Figure 5:
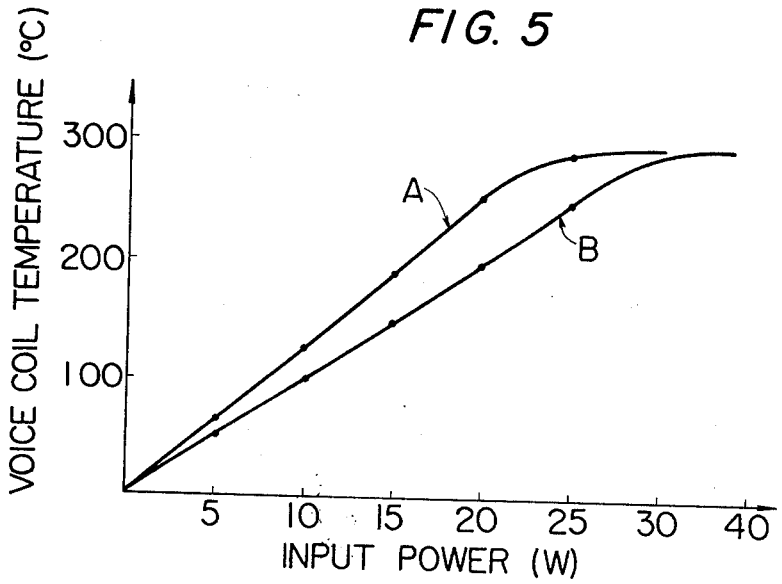
FIG. 5 is a graph showing the temperature characteristic of the voice coil assembly shown in FIG. 3.

FIG. 5 is a graph showing the input power to voice coil temperature characteristics of the conventional speaker and the speaker which includes the above described first embodiment voice coil assembly. A curve A indicates the temperature characteristic of the conventional speaker, while another curve B indicates the temperature characteristic of the speaker which comprises the first embodiment voice coil assembly. The slope of the curve B is lower than that of the curve A and this means that the temperature of the voice coil is lower in case that the metallic layer 14 is provided than in case that such a metallic layer is not employed when the input power is maintained at a constant value. It will be understood from the graph of FIG. 5, that the input power to temperature characteristic is improved by about 30 percent compared to the conventional speaker.

In the above description, although it has been set forth that the metallic layer or plate 14 is made by photochemical etching processes, the metallic layer 14 may be formed after the spiral pattern coil 12 is made. For instance, a metallic plate or sheet having a given shape may be placed on the substrate 10 by means of suitable adhesive or vapour coating technique.

Figure 6:
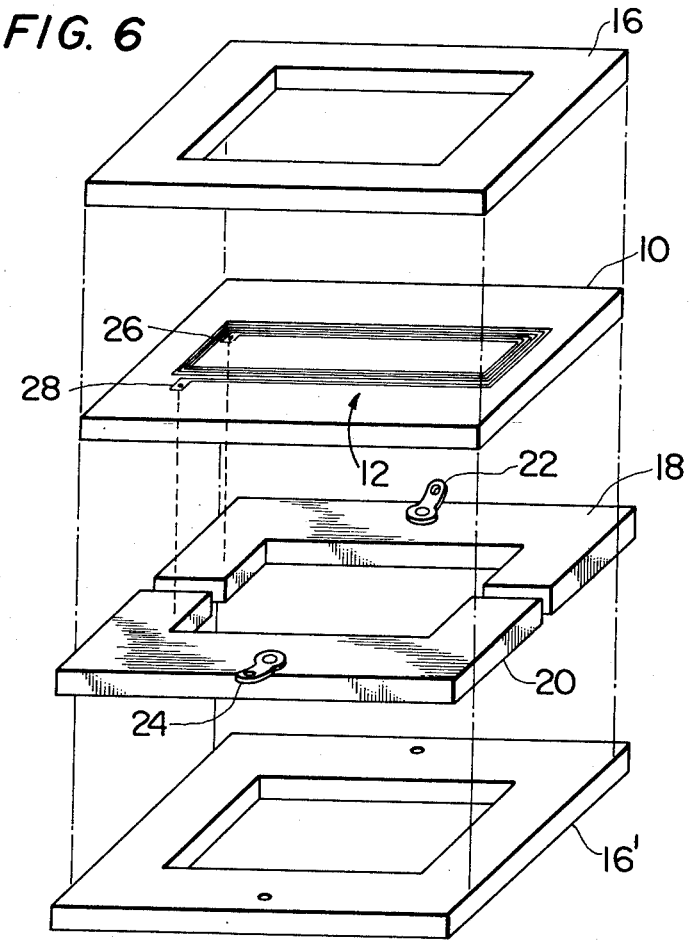
FIG. 6 is an exploded view of a second embodiment of a voice coil assembly according to the present invention.
Figure 7:
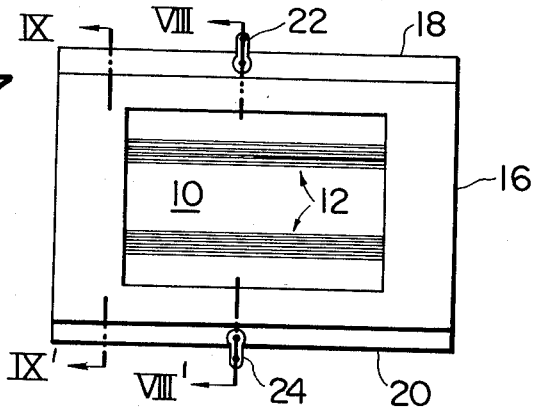
FIG. 7 is a top plan view of the voice coil assembly shown in FIG. 6.
Figure 8:
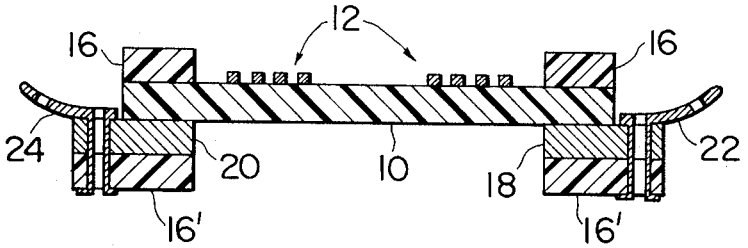
FIG. 8 is a cross-sectional view of the voice coil assembly shown in FIG. 7 taken along the line VIII--VIII'.
Figure 9:
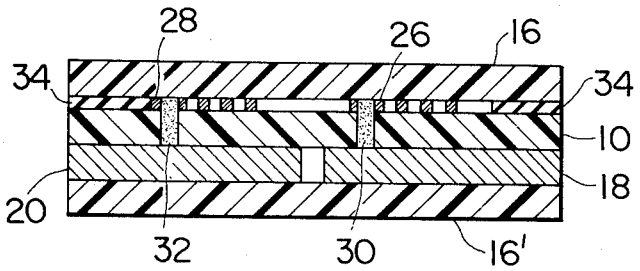
FIG. 9 is a cross-sectional view of the voice coil assembly shown in FIG. 7 taken along the line IX–IX'.

Referring now to FIG. 6 which shows an exploded view of the second embodiment of the voice coil assembly according to the present invention, a pair of metallic plates 18 and 20 are additionally provided. The second embodiment voice coil assembly is further shown by its top plan view in FIG. 7 and two cross-sectional views in FIG. 8 and FIG. 9. The first cross-sectional view of FIG. 8 is that taken along the line VIII–VIII' of FIG. 7, while the second cross-sectional view of FIG. 9 is that taken along the line IX–IX' of FIG. 7. The same elements also used in the first embodiment are designated by like reference numerals.

As shown in FIG. 6, the substrate 10 on which the spiral pattern voice coil 12 is formed, is interposed between first and second holders 16 and 16' in the same manner as in the first embodiment. However, according to the second embodiment a pair of U-shaped metallic plates 18 and 20 are additionally provided between the substrate 10 and the second holder 16', while the metallic layer 14 surrounding the voice coil 12 is omitted. However, if desired, the first and second embodiments may be combined as will be described hereinlater. Each of the metallic plates 18 and 20 is substantially U-shaped and is equipped with an external terminal strip 22 or 24. These U-shaped metallic plates 18 and 20 are spaced from each other by a given distance so that these members are electrically insulated from each other. The dimention of the second holder 16' is slightly larger than that of the first holder 16 or the substrate 10 so that the metallic plates 18 and 20 will be placed on the second holder 16' in such a manner that the external terminal strips 22 and 24 may be exposed outside when all of the members of the voice coil assembly are piled up.

Although a metallic layer for heat dissipation is not formed on the front side of the substrate 10 in this second embodiment, such a metallic layer employed in the first embodiment may be also used. The U-shaped metallic plates 18 and 20 are made of a suitable metal the thermal conductivity is high. In this embodiment, copper is used as the material of the U-shaped metallic plates 18 and 20. These U-shaped metallic plates are used not only for the dissipation of the heat generated by the voice coil 12 but also for the establishment of the electrical contacts between the terminals 26 and 28 of the voice coil 12 and the external terminal strips 22 and 24. Although the metallic plates 18 and 20 are placed on the back side of the voice coil 12, the metallic plates 18 and 20 transmit the heat generated by the voice coil 12 effectively to the holders 16 and 16' and to the ambient air.

The electrical connections between the voice coil terminals 26 and 28 and the external terminal strips 22 and 24 are established as follows: As shown in FIG. 6 and FIG. 9, the voice coil terminals 26 and 28 has its dimensions much larger than the width of the voice coil 12. For instance, each of the voice coil terminals 26 and 28 has a square shape of 4×4 millimeters, while the width of the voice coil is less than 500 microns. In each of the voice coil terminals 26 and 28 a through-hole is made at the center of the square shape. The diameter of the through-hole is about 2 millimeters. These through-holes are made by drilling and thus two through-holes are also made in the substrate 10 at corresponding portions. Therefore, two through-holes are made in the voice coil assembly to penetrate the voice coil terminals 24 and 28 and the substrate 10. When assembling the voice coil assembly, the vibrating plate, i.e. the substrate 10 on which the spiral pattern voice coil 12 is already formed, the metallic plates 18 and 20, and the second holder 16' are piled first. The through-holes made in the voice coil terminals 26 and 28 and the substrate 10 are respectively filled with solder 30 and 32 so that an electrical connection between the first terminal 26 and the first U-shaped metallic plate 18 is achieved, while an electrical connection between the second terminal 28 and the second U-shaped metallic plate 20 is attained. After solder is inserted in the through-holes, the first holder 16 is placed on the substrate 10 by means of adhesive 34.

The external terminal strips 22 and 24 are respectively fixed to the first and second U-shaped metallic plates 18 and 20 by means of grommets (metal eyelets). As shown in FIG. 6 and FIG. 8 the grommet portion of each external terminal strip 22 and 24 is inserted in a through-hole made in the U-shaped metallic plate 18 or 20 and the second holder 16'. The U-shaped metallic plates 18 and 20 and the external terminal strips 22 and 24 are of course made of a conductive material, and therefore, the electrical connections between the voice coil terminals 26 and 28 and the external terminal strips 22 and 24 are respectively established.

From the foregoing description, it will be understood that the U-shaped metallic plates 18 and 20 serve as both heat dissipation means and electrical conducting means.

Figure 10:
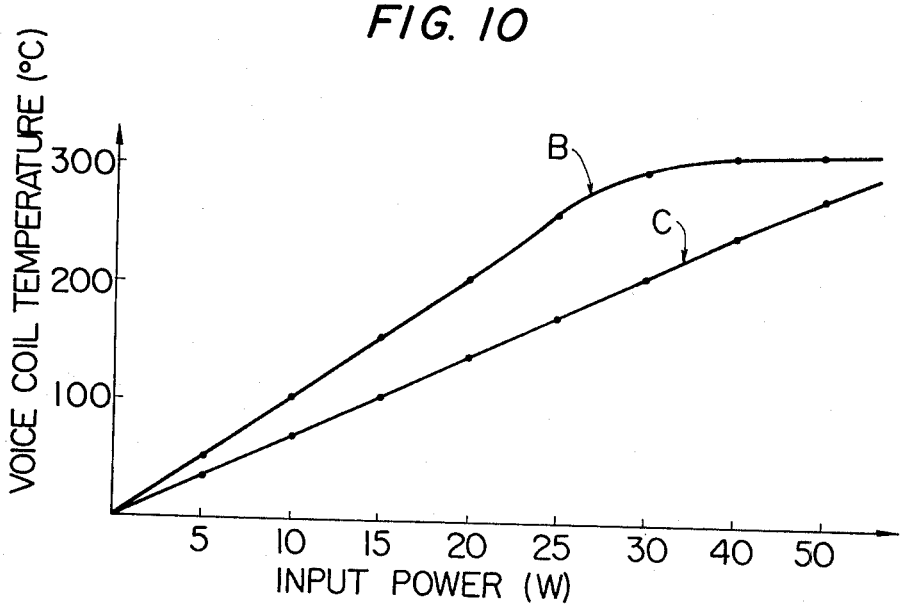
FIG. 10 is a graph showing the temperature characteristic of a third embodiment which corresponds to the combination of the first and second embodiments respectively shown in FIGS. 3 and 4 and FIGS. 6, 7, 8 and 9.

As described hereinbefore, the first and second embodiments may be combined. The combination of the first and second embodiments means that a metallic layer 14 shown in FIG. 3 and FIG. 4 is employed in the second embodiment voice coil assembly. This combination may be referred to as the third embodiment. The advantage of the third embodiment is that the efficiency of heat dissipation is further improved compared to the first and second embodiments. FIG. 10 is a graph showing the input power to voice coil temperature characteristic of the third embodiment voice coil assembly. In this graph two curves B and C are shown in which the curve B corresponds to the curve B in the graph of FIG. 5. Namely, the curve B indicates the temperature variation in the first embodiment voice coil assembly, while the other curve C indicates the temperature variation in the third embodiment. As will be apparent from the difference between the two curves B and C, the efficiency of heat dissipation is increased by employing the two U-shaped metallic plates 18 and 20.

Figure 15:
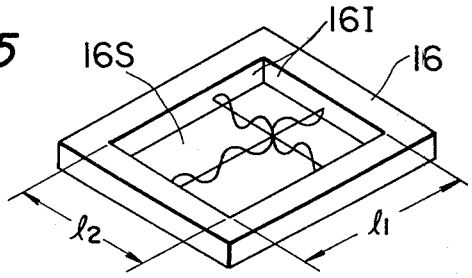
FIG. 15 is an explanatory view of a voice coil holder for illustrating standing waves generated by the holder.

In the above described first to third embodiments of the voice coil assembly, the shape of the central opening of the holders 16 and 16' is rectangular. One of the holders 16 and 16' is shown schematically in FIG. 15. When a holder having a rectangular opening is used, standing waves are generated in the space defined by the opening. The reason for the occurrence of these standing waves is that the central opening is defined by two pairs of parallel sides 16I. In other words, a pair of sides which face to each other and which are equidistantly spaced from each other results in occurrence of standing waves.

The frequency of the standing waves will be expressed in terms of:

$$f = \frac{C}{2}\sqrt{\left(\frac{l}{l_1}\right)^2 + \left(\frac{n}{l_2}\right)^2} \text{ (Hz)}$$

wherein

C=331.5+0.61t (m/sec) . . . sound velocity;

"t" is the temperature in degrees centigrade;

"l"$_1$ is the length of a longitudinal side of the opening in meters;

"l"$_2$ is the length of the transverse side of the opening in meters;

"l" is an integer indicative of the order of the higher-harmonic of the standing waves along the direction of $l_1$; and "n" is an integer indicative of the order of the higher-harmonic of the standing waves along the direction of $l_2$.

These standing waves developed in the space defined by the openings of the first and second holders 16 and 16' cause the frequency characteristic of the speaker to be deteriorated. As shown by a curve A in the graph of FIG. 16, irregularities occur in the frequency characteristic curve. Since the reason for the occurrence of the standing waves in the central opening of the holders 16 and 16' is that the shape of the opening of each holder is rectangular, the inventors of the present invention had experiments by using holders the shape of the opening of which is other than rectangular.

Figure 11:
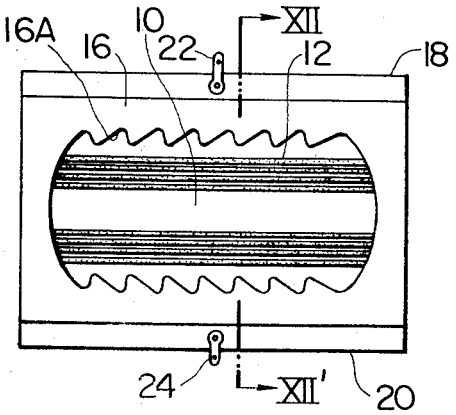
FIG. 11 is a top plan view of a fourth embodiment of a voice coil assembly according to the present invention.
Figure 12:
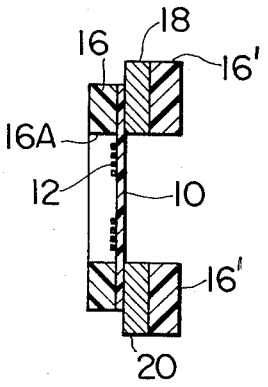
FIG. 12 is a cross-sectional view of the voice coil assembly shown in FIG. 11 taken along the line XII–XII'.

Hence, reference is now made to FIG. 11 which shows a fourth embodiment of the voice coil assembly according to the present invention. The top plan view of the fourth embodiment voice coil assembly is shown in FIG. 11, while a cross-sectional view taken along the line XII–XII' of FIG. 11 is shown in FIG. 12. The fourth embodiment voice coil assembly is substantially the same as the second embodiment except that the shape of the central opening of the holders 16 and 16' is made different from rectangular shape.

As clearly illustrated in FIG. 11, two sides of the opening of the first holder 16 is made undulatory, while the other two sides are curved. The undulatory sides are made wave-like. Although FIG. 11 only shows the top plan view of the fourth embodiment, and thus the central opening of the first holder 16 is shown, the second holder 16' has the same or similar shape. Furthermore, the first and second U-shaped metallic plates 18 and 20 may have corresponding undulatory portions and curved portions so as to match the shape of the second holder 16'. In this embodiment two longitudinal sides of the openings of the first and second holders 16 and 16' have wave-like undulatory portions, while the transverse sides thereof have curved portions. However, if desired, the transverse sides may also have wave-like undulatory portions.

Figure 16:
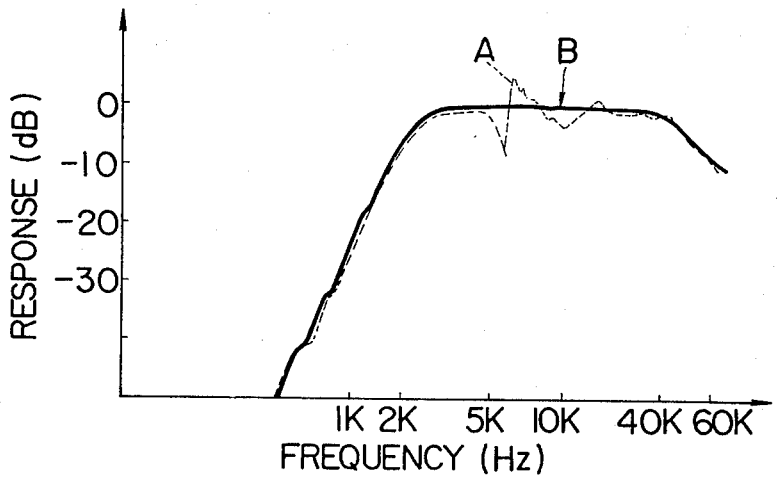
FIG. 16 is a graph showing the frequency characteristic of a speaker including the fourth embodiment voice coil assembly according to the present invention.

With the provision of the fourth embodiment voice coil assembly, the frequency characteristic of the speaker which comprises the voice coil assembly is remarkably improved in which the frequency characteristic is substantially flat in the operating range as indicated by a curve B of the graph of FIG. 16. Such a flat frequency characteristic contributes to high quality and fidelity sound reproduction.

Figure 13:
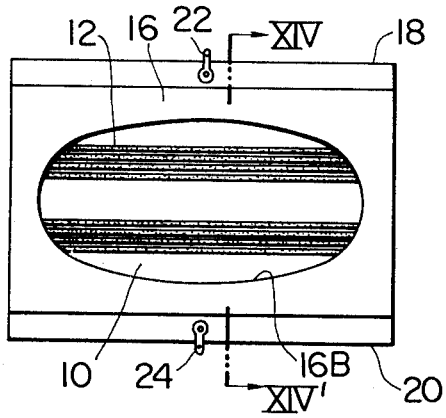
FIG. 13 is a top plan view of a fifth embodiment of a voice coil assembly according to the present invention.
Figure 14:
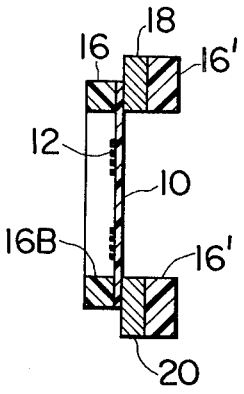
FIG. 14 is a cross-sectional view of the voice coil assembly shown in FIG. 13 taken along the line XIV–XIV'

FIG. 13 and FIG. 14 show a fifth embodiment of the voice coil assembly according to the present invention. The fifth embodiment is substantially the same as the fourth embodiment except that the shapes of the openings of the first and second holders 16 and 16' are oval. When the shapes of the openings of the first and second holders 16 and 16' are made oval, the generation of standing waves is prevented or at least reduced, and therefore, similar effect is obtained improving the frequency characteristic in the same manner.

In the above description of the fourth and fifth embodiment, it has been described that these embodiments are modifications of the second embodiment which includes two metallic plates 18 and 20 and the second holder 16'. However, the first embodiment, which comprises a metallic layer formed on the front side of the substrate 10, may be modified by utilizing a pair of holders having an opening with undulatory portions and/or curved portions. Furthermore, the number of the holders may be reduced to one. For instance one of the holders 16 and 16' may be omitted if there is no problem in connection with the strength of the coil assembly. Also it is possible to combine the first and fourth embodiments and the first and fifth embodiments. In other words, the substrate 10 shown in FIGS. 11 to 14 may comprise a metallic layer such as 14 in FIG. 3 and FIG. 4, formed on the front surface thereof.

What is claimed is:

1. A voice coil assembly for a speaker comprising:

(a) a nonconductive substrate which functions as a vibrating plate, said substrate having front and back sides;

(b) a spiral pattern coil formed on said front side of said substrate;

(c) holding means for supporting said substrate at the periphery of said substrate;

(d) means for permitting the dissipation of the heat generated by said coil, the heat dissipating means including at least one layer made of a metal, the metallic layer being attached to said substrate.

2. A voice coil assembly as claimed in claim 1, wherein said heat dissipating means comprises a thin metallic layer deposited on said front side of said substrate, said thin metallic layer surrounding said coil where the inner most portions of said thin metallic layer is located adjacent to the outer most portions of said coil.

3. A voice coil assembly as claimed in claim 1, wherein said heat dissipating means comprises a pair of metallic plates placed on said back side of said substrate, each of said metallic plates having an external terminal strip and being electrically connected to one of the terminals of said coil via a through-hole made in said substrate, said metallic plates being electrically insulated from each other.

4. A voice coil assembly as claimed in claim 2, wherein said heat dissipating means further comprises a pair of metallic plates placed on said back side of said substrate, each of said metallic plates having an external terminal strip and being electrically connected to one of the terminals of said coil via a through-hole made in said substrate, said metallic plates being electrically insulated from each other.

5. A voice coil assembly as claimed in claim 3 or 4, wherein each of said metallic plates is substantially U-shaped.

6. A voice coil assembly as claimed in claim 3 or 4, wherein said holding means comprises a holder having an opening at the center thereof, said holder being attached via said pair of metallic plates to said back side of said substrate.

7. A voice coil assembly as claimed in claim 3 or 4, wherein said holding means comprises first and second holders, each of which has an opening at the center thereof, said first holder being attached to said substrate at its front side while said second holder is attached via said pair of metallic plates to said back side of said substrate.

8. A voice coil assembly as claimed in claim 6, wherein the dimension of said holder is larger than said substrate, each of said metallic plates being interposed between said substrate and said holder in such a manner that at least a portion of each of said metallic plates is exposed outside, each of said external terminal strips being attached to said exposed portion of each metallic plate.

9. A voice coil assembly as claimed in claim 7, wherein the dimension of said second holder is larger than said substrate each of said metallic plates being interposed between said substrate and said second holder in such a manner that at least a portion of each of said metallic plates is exposed outside, each of said external terminal strip being attached to said exposed portion of each metallic plate.

10. A voice coil assembly as claimed in claim 3 or 4, wherein said external terminal strip comprises a grommet, said grommet being inserted in a through-hole made in said each metallic plate and said holding means.

11. A voice coil assembly as claimed in claim 3 or 4, wherein said through-holes made in said substrate are respectively filled with solder.

12. A voice coil assembly as claimed in claim 1, wherein said holding means comprises at least one holder having an opening at the center thereof, the periphery of said opening is made undulatory.

13. A voice coil assembly as claimed in claim 1, wherein said holding means comprises at least one holder having an opening at the center thereof, the periphery of said opening is made curved.

14. A voice coil assembly as claimed in claim 1, wherein said holding means comprises at least one holder having an opening at the center thereof, said opening being defined by longitudinal and transverse sides, said longitudinal sides being made wave-like undulatory, while said transverse sides are made curved.

15. A voice coil assembly as claimed in claim 13, wherein said periphery is so curved that the shape of said opening is an oval.

16. A voice coil assembly as claimed in claim 7, wherein each of said first and second U-shaped metallic plates are so shaped that they match the shapes of the periphery of said openings of said first and second holders.

17. A speaker unit comprising:

(a) a vibrating plate having a nonconductive substrate, a voice coil and a metallic layer, said voice coil and said metallic layer being formed on the front side of said substrate, said voice coil having a spiral pattern microstripline and two terminals at both ends thereof, said metallic layer having a thin film deposited outside said voice coil, the outer most portions of said voice coil being spaced from the inner most portions of said metallic layer by a short distance;

(b) first and second metallic plates attached on the back side of said substrate, each of said first and seocnd metallic plates having an external terminal strip and being electrically connected to one of said terminals of said voice coil through a conductor filled in a through-hole made in said substrate, said first and second metallic plates being U-shaped and spaced from each other;

(c) first and second holders for supporting said vibrating plate at the periphery of said vibrating plate, said first holder being attached to said vibrating plate at the front side of said substrate, while said second holder is attached to the other side of said vibrating plate via said first and second metallic plates, each of said first and second holders has an opening at the center thereof, the periphery of said opening being undulatory and/or curved; and (d) a plurality of permanent magnets disposed adjacent to said voice coil.

* * * * *